US005419318A

United States Patent [19]

Tayebi

[11] Patent Number: 5,419,318

[45] Date of Patent: May 30, 1995

[54] BREATHING MASK

[75] Inventor: Amad Tayebi, Westford, Mass.

[73] Assignee: Better Breathing, Inc., Lawrence, Mass.

[21] Appl. No.: 104,990

[22] Filed: Aug. 10, 1993

Related U.S. Application Data

[63] Continuation of Ser. No. 704,316, May 21, 1991, abandoned.

[51] Int. Cl.[6] ..... A62B 7/10

[52] U.S. Cl. ..... 128/205.27; 128/205.29; 128/206.19; 128/206.23; 128/206.24

[58] Field of Search ..... 128/863, 201.15, 205.27, 128/205.29, 206.16, 206.17, 206.19, 206.23, 206.24

[56] References Cited

U.S. PATENT DOCUMENTS

| | | | |
|---|---|---|---|
| 601,401 | 3/1898 | Praeckel | 128/206.24 |
| 1,582,164 | 4/1926 | Burstyn | 128/863 |
| 1,837,591 | 12/1931 | Shindel | 128/206.24 |
| 1,925,764 | 9/1933 | Le Duc | 128/206.24 |
| 2,029,947 | 2/1936 | Schmitt et al. | 128/863 |
| 2,116,241 | 5/1938 | Heumann | 128/863 |
| 2,201,315 | 5/1940 | Lehmberg | 128/206.17 |
| 2,296,775 | 9/1942 | Dockson | 128/863 |
| 2,845,927 | 4/1958 | Hill | 128/206.17 |
| 3,170,461 | 2/1965 | Watts, Jr. | 128/863 |
| 3,521,630 | 7/1970 | Westberg et al. | 128/206.24 |
| 4,037,593 | 7/1977 | Tate, Jr. | 128/863 |
| 4,167,185 | 9/1979 | Lewis . | |
| 4,384,577 | 5/1983 | Huber et al. | 128/206.19 |
| 4,470,413 | 9/1984 | Warncke | 128/206.24 |
| 4,574,799 | 3/1986 | Warncke | 128/206.24 |
| 4,641,645 | 2/1987 | Tayebi | 128/206.19 |
| 4,677,977 | 7/1987 | Wilcox | 128/206.24 |
| 4,739,755 | 4/1988 | White et al. | 128/206.24 |
| 4,796,621 | 1/1989 | Barle et al. | 128/206.23 |
| 4,827,924 | 5/1989 | Japuntich | 128/206.19 |
| 4,856,508 | 8/1989 | Tayebi | 128/206.17 |
| 4,905,683 | 3/1990 | Cronjaeger | 128/206.24 |
| 4,945,907 | 8/1990 | Tayebi | 128/206.17 |
| 4,965,887 | 10/1990 | Paoluccio et al. | 128/863 |
| 5,020,533 | 6/1991 | Hubbard et al. | 128/206.23 |

*Primary Examiner*—Edgar S. Burr
*Assistant Examiner*—Aaron J. Lewis
*Attorney, Agent, or Firm*—Joseph E. Funk

[57] ABSTRACT

A breathing mask is disclosed which features a soft, flexible face contacting member and an outer shell member fastened thereto to form a mask. The face contacting member is formed in an arctuate shape that provides a cup in which the chin of the mask wearer rests to prevent the mask from slipping under the chin of the wearer, and a peripheral rim over the nose of the wearer that secures the bottom edge of eye glasses or protective eyewear between the rim and the face of the mask wearer. The outer shell member is either an air permeable material for filtering particulates and/or gases from breathed air, or may be a rigid air impervious material through which filter cartridges are mounted to filter breathed air.

3 Claims, 4 Drawing Sheets

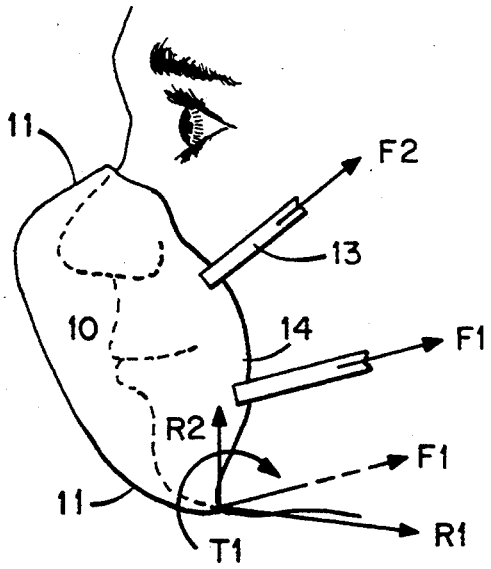
Fig. 1. [PRIOR ART]
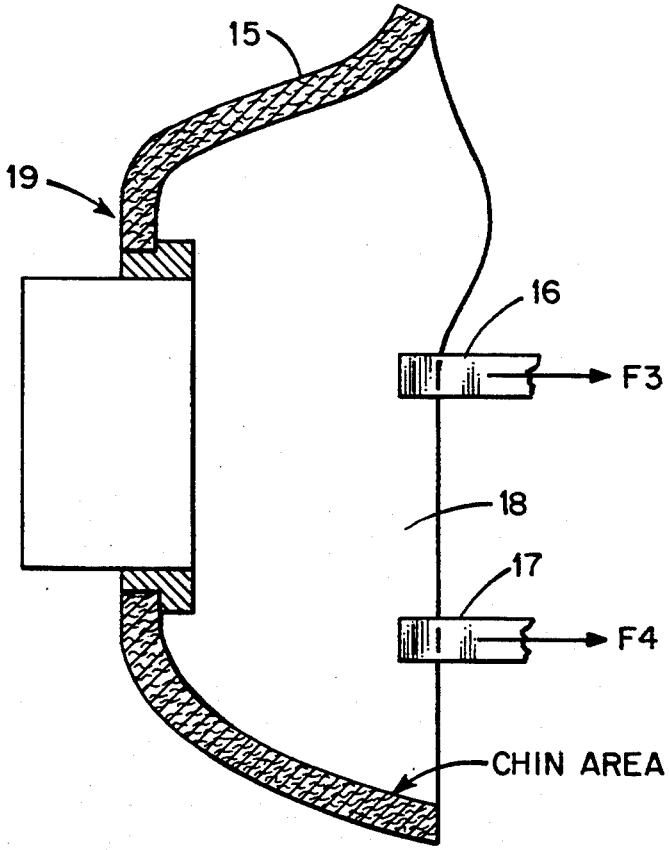
Fig. 2. [PRIOR ART]

BREATHING MASK

This is a continuation of patent application Ser. No. 704,316, filed May 21, 1991, now abandoned.

FIELD OF THE INVENTION

The present invention relates to breathing masks that cover the nose and mouth of the wearer while filtering breathed air. In particular, the breathing mask of the present invention addresses the need for secure and stable mounting of the mask on the wearer's face, effective sealing around the periphery of contact with the wearer's face while utilizing very low magnitude pulling force against the face of the wearer. While the breathing mask of the present invention resists the tendency to slip under the chin, it also features a small lip or ridge around the periphery of the assembled mask behind which the eyeglasses or protective eyewear on the mask wearer is securely retained in even a better manner than if the breathing mask were not worn.

BACKGROUND OF THE INVENTION

A relevant detailed background of respirators of the prior art is given in U.S. Pat. Nos. 4,641,645–4,856,508 and 4,945,907.

A common problem in limited use or disposable breathing respirators of the prior art is that the chin portion of the respirator tends, due to the force pulling the respirator against the wearer's face, to slip under the wearer's chin. This results in the undesirable situation where the interior of the respirator shell touches the lips of the wearer. It also results in the periphery of the respirator shifting downward and, therefore, in some cases resulting in leakage between the periphery of the respirator and the wearer's face. In order to overcome such tendency for downward shifting of the respirator on the wearer's face, an excessive force is applied on the top portion of the respirator in order to increase the frictional resistance between the face of the wearer and the periphery of the respirator. The application of such force, however, makes it uncomfortable for the wearer to continue to wear the respirator for extended periods of time.

Accordingly, there is a need in the art for limited use or disposable respirators that are more comfortable, inexpensive, flexible and light-weight which can rest securely against the wearer's face, resist slipping under the chin of the wearer and achieve an air-tight seal around the periphery of contact with the wearer's face under a very low magnitude pulling force. The breathing mask of the present invention addresses and meets the above needs.

DESCRIPTION OF THE DRAWING

The present invention will be better understood upon reading the following detailed description in conjunction with the drawing in which:

FIG. 1 is a side view of a prior art disposable, fibrous breathing mask;

FIG.2 is a side cutaway view of a prior art breathing mask having an air impermeable foam shell;

DETAILED DESCRIPTION

Figure 3:
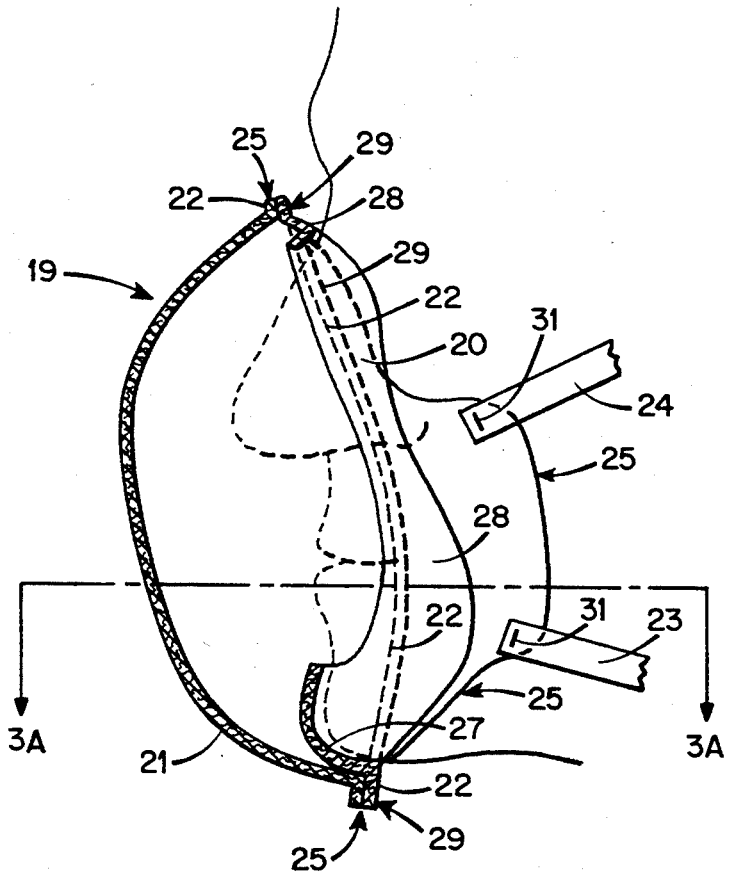
FIG. 3 is a side cutaway view of a breathing mask in accordance with the present invention.

In FIG. 1 is shown a side view of a prior art disposable, fibrous breathing mask 10. As shown therein, the profile of the fibrous shell 11 is a single curvature continuous curve in the zone above, in front of and below the chin of the wearer of the mask 10. Elastic bands 12 and 13, attached to the periphery 14 of the mask shell pass around the head of the wearer of the mask 10 to hold the mask against the face of the wearer. The tensile stretch forces F1 and F2 applied to elastic bands 12 and 13 secure the mask to the wearer's face and provide an effective seal between the wearer's face and the periphery of the mask. As shown therein, however, force F1 may be replaced by a torque T1 and force components R1 and R2 acting along and perpendicular to the common tangent to the interior of the mask shell and the wearer's chin point of contact, respectively. Component R1 tends to pull the mask of the prior art under the chin of the wearer, and, thereby bring the interior of mask shell 11 into contact with the tip of the nose and/or the tip of the wearer's lips. In addition, due to such slippage, the seal around the top portion of the periphery of the mask of the prior art may be disturbed. In FIG. 2 is shown a side cutaway view of a prior art breathing mask 19 having an air impermeable foam shell 15. Again, as shown therein, the profile of the foam shell 15 in the chin area is a single curvature continuous curve. Also, elastic bands 16 and 17, attached to the periphery 18 of the foam mask shell, pass around the head of the wearer of the mask 19 to hold the mask against the face of the wearer. The tensile stretch forces F3 and F4 applied to elastic bands 16 and 17 secure the mask to the wearer's face and provide an effective seal between the wearer's face and the periphery of the mask. Again, such breathing mask of the prior art suffers of the tendency of the chin portion to slip under the wearer's chin and cause the same inconveniences and loss of seal detailed above.

FIG. 3 is a side cutaway view of a breathing mask 19 in accordance with a first embodiment of the present invention. The mask is made up of a face contacting portion 20 that is formed of soft, resilient air impervious polymeric foam. For the purpose of describing the present invention, an impermeable polymeric foam shall be defined as a medium which is impermeable to the flow of gases and liquids and having a mass density lower than the product of the standard mass density of water (62.4 lbm/cu ft) and the specific gravity of the solid consistency of the polymer or combination of polymers from which the mask shell face contacting portion 20 is made. In accordance with this definition, an initially permeable fibrous sheet or open cell foam sheet coated or sealed on one or both sides in order to be impermeable to the flow of fluids may be defined as an impermeable polymeric foam. Other materials that may alternatively be used to make the subject mask shell are combinations of laminates of polymeric sheets or films, fibrous webs, fabrics, open cell foams and/or closed cell foams. In a typical case of this first embodiment of the present invention, the face contacting portion 20 is made of a closed cell low density polyethylene foam, ⅛" thick and with density of 4 lb./cu ft. There is also an outer shell member 21 which is made of air permeable, filtration, fibrous material. Face contacting portion 20 is bonded to the periphery of outer shell member 21 at zone 22. There are elastic bands 23 and 24 attached to the mask shell at points near the periphery 25 of mask 19 where face contacting portion 20 and outer shell member 21 are bonded to each other as shown. Bands 23 and 24 pass around the head of a wearer of the mask and hold the mask securely against the face of a wearer of the mask.

Figure 3A:
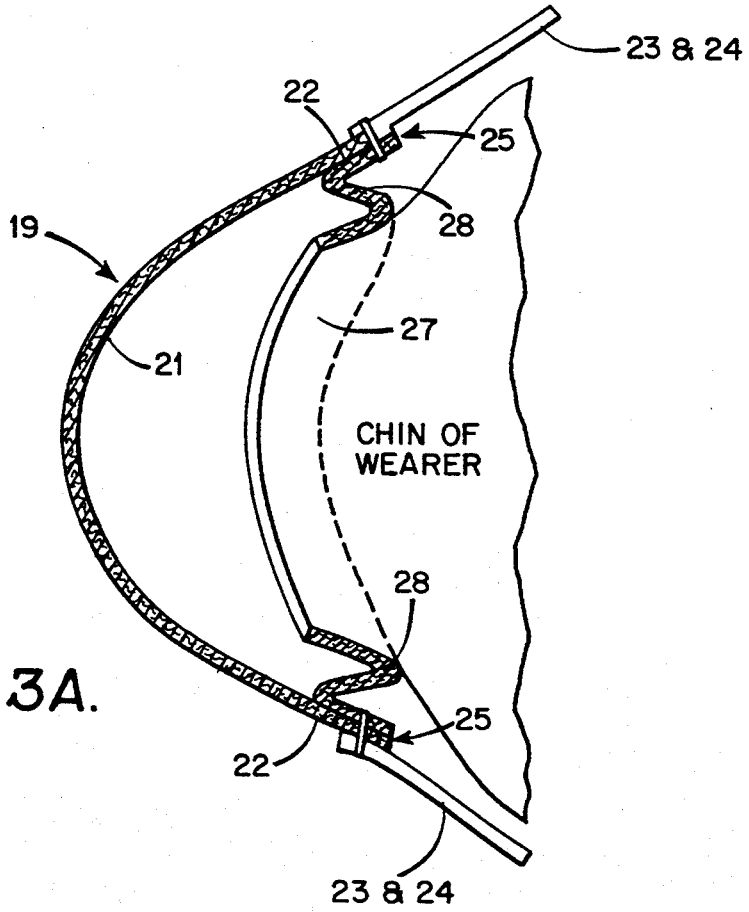
FIG. 3A is cross-sectional view, looking downward from above the head of the wearer of the mask, that shows the arctuate shaped periphery of the mask.

Face contacting portion 20 has a large central opening 26 that surrounds the nose and mouth of the wearer of the mask. The periphery of opening 26 is preferably formed into an arctuate shape 28 as also shown in FIG. 3A that is inwardly inverted so that its innermost surface is conformed to and touches the face of the wearer of the breathing mask to provide an air-tight seal around the periphery of face contacting portion 20 of the mask 19 to the wearer's face.

As may be seen in FIG. 3, the arctuate shape 28 of the face contacting portion 20 forms a cup 27 under and in front of the chin of a wearer of the mask 19. This formed cup prevents mask 19 from sliding under the wearer's chin and the interior of the face mask outer shell member 21 from touching the face of the wearer. In addition it also provides a good mask to face seal around the chin of the wearer of the mask. The arctuate shape 28 of the face contacting portion 20 also provides a good seal to the face of the mask wearer around the bridge of the nose and the cheeks so that a good seal is achieved without strong forces being applied to the mask shell to force it against the face of the wearer.

Figure 4:
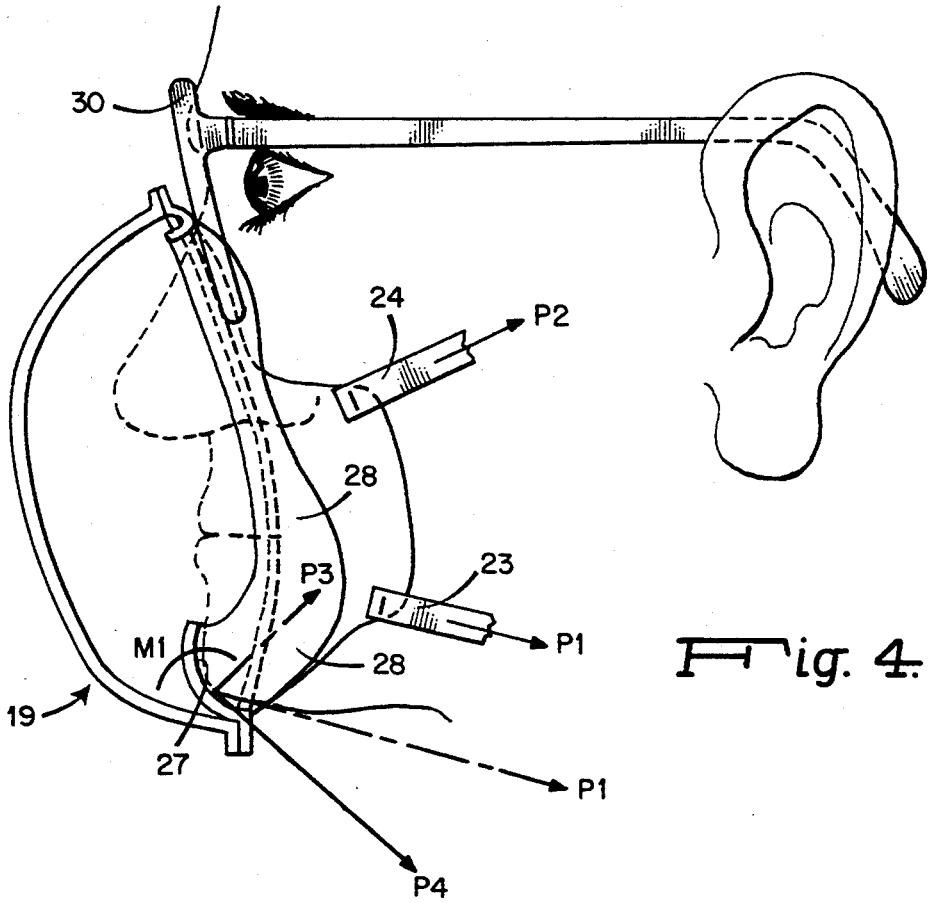
FIG. 4 is side view of the breathing mask in accordance with the present invention and .showing the forces that hold the mask against the face of a wearer thereof to accomplish an air-tight seal around the periphery of the mask shell when the mask is worn.

FIG. 4 is side view of the breathing mask in accordance with the present invention showing the forces that hold the mask 19 against the face of the wearer to accomplish an air-tight seal around the periphery of face contacting portion 20 of the mask shell when the mask is worn. Elastic bands 23 and 24 generate forces P1 and P2 as shown. Force P1 results in other forces P3 and P4 and moment M1 at the chin of the wearer of the face mask 19 as shown. Force P3 presses the chin cup 27 of face contacting portion 20 against the chin of the wearer and thereby results in a good mask to face seal around the chin of the wearer of the mask. Moment M1 also presses chin cup 27 against the wearer's chin for additional chin to chin cup seal. Force P4 tends to pull the mask 19 under the chin of the wearer, as in the prior art. However, cup 27 formed by the arctuate ridges 28 of face contacting portion 20 prevents mask 19 from sliding under the chin of the wearer of the mask.

Cup 27 thereby acts as a pivot point and Force P2 only causes mask 19 to be pulled against the face of the mask wearer while there is no tendency for the mask to slip under the chin of the wearer. Due to the low modulus resiliency of arctuate shaped ridges 28 and face contacting portion 20, force P2 need only be of low magnitude to achieve an air-tight seal around the nose and cheeks area of face contacting portion 20. This air-tight seal can be achieved with almost no deformation to the face of the mask wearer. In a typical case of application of the present invention, where face contacting portion 20 was made of a closed cell low density polyethylene foam, (⅛" thickness, 2 lb./cu density), less than one pound of force was applied by band 24 and yet an air-tight seal between the face contacting portion 20 and the wearer's face was achieved.

In addition, due to this low force air-tight seal around the nose and cheeks area of the mask wearer, the portion of zone 22 that is atop the nose of the mask wearer may be relatively low to facilitate the mask wearer wearing eye glasses or protective eye wear. As described above, face contacting portion 20 is bonded to the periphery of outer shell member 21 at zone 22. This creates a small lip or ridge 29 around the periphery of the assembled mask. Eye glasses or protective eye wear 30 on the mask wearer rest between this small lip 29 and the face of the wearer. Thus, the eye glasses are securely retained on the wearer in even a better manner than if they were not wearing the breathing mask.

Figure 5:
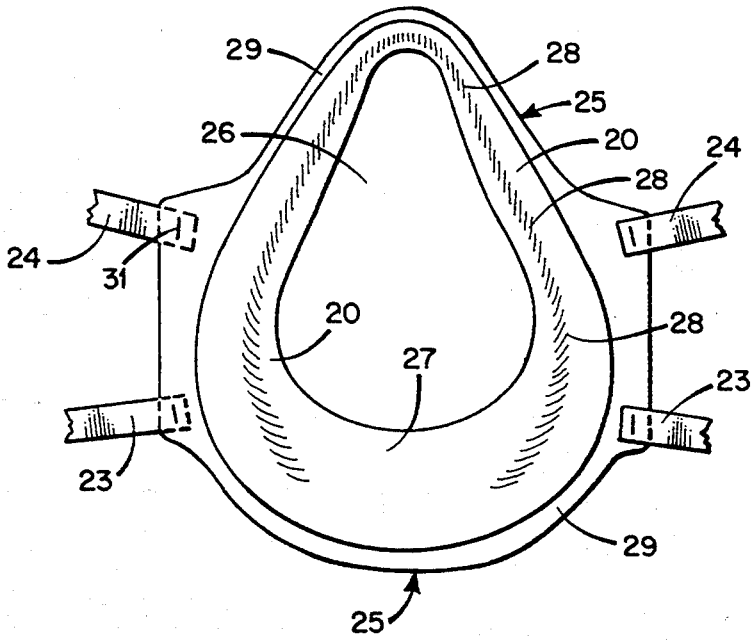
FIG. 5 is a rear view of the breathing mask in accordance with the present invention.

FIG. 5 is a rear view of the breathing mask in accordance with the present invention. The shape of opening 26 in face contacting portion 20 is seen in this figure. In addition, the shape of the arctuate ridges 28 and chin cup 27 formed thereby is seen.

Referring back to FIG. 3, showing a first embodiment of the breathing mask in accordance with the present invention, outer shell member 21 may be made of a fibrous filtration shell covering the nose and mouth of the wearer. The fibrous filtration shell is preferably thermoformed and has a stiffness sufficient that it retain its shape. A fibrous filtration shell is used to filter particulates including dusts and mists from breathed air. The material from which fibrous filtration shell 21 is formed may also be a composite material known in the and made up of a number of layers including an activated charcoal impregnated layer that is able to absorb gases and filter particulates from breathed air. Elastic bands 23 and 24 are fastened to mask 19, as shown, by staples 31, thermobonding or adhesives. In addition, a one-way exhaust valve 35 may be installed through the wall of fibrous filtration shell 21 to exhaust exhaled air in, a manner well known in the art.

Figure 6:
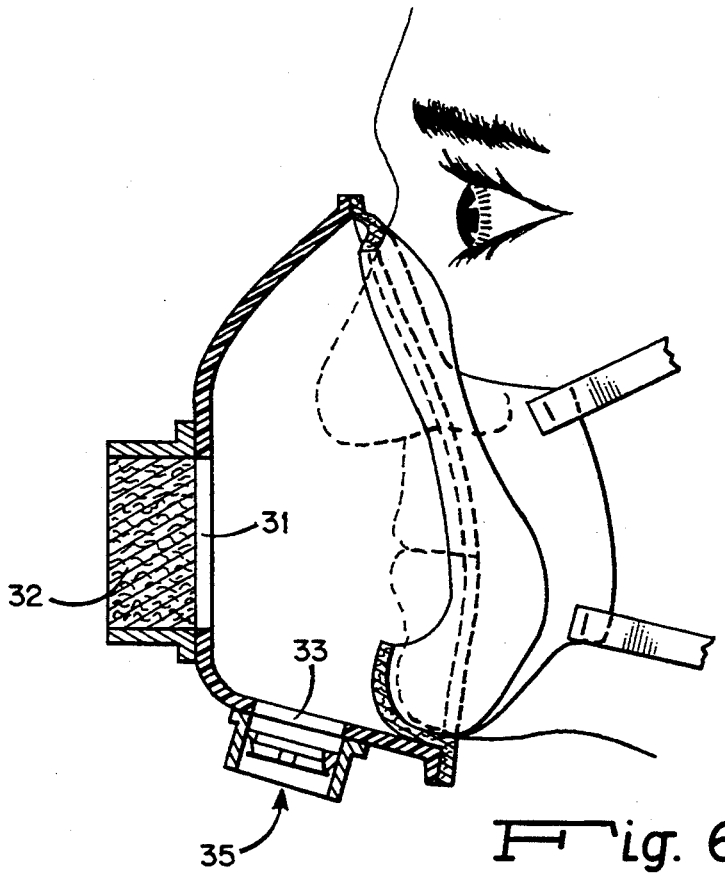
FIG. 6 is a side cut away view of the breathing mask in accordance with an alternative embodiment of the present invention.

FIG. 6 is a side cut away view of the breathing mask in accordance with an alternative embodiment of the invention. In this embodiment, outer shell member 21 is formed of a thin plastic, light weight, air impervious shell covering the nose and mouth of the wearer and having at least one opening in which a filter cartridge and/or exhalation valve and/or fibrous filtration liner and/or a breathable-air-supplying conduit may be mounted. The combination of outer shell member 21 and face contacting portion 20 is very light. In a typical case, it weighs only about one ounce. In this embodiment the plastic from outer shell member 21 is formed is high density polyethylene and is only 0.030 of an inch thick. Other relatively thin plastic materials may also be used. Outer shell member 21 may be injection molded or thermoformed plastic shell. In its preferred embodiment, outer shell member 21 is a thermoformed plastic shell.

As shown, there is at least one hole 31 through the air impervious outer shell member 21. In this hole 31 is mounted a filter cartridge 32 of a type well known in the art. This filter cartridge 32 absorbs gases and filter particulates from breathed air. In addition, a one-way exhaust valve 35 may be installed in another opening 33 in the wall, preferably near the bottom of thin plastic outer shell member 21 to exhaust exhaled air in a manner well known in the art.

This combination of relatively more rigid outer shell member 21 and face contacting portion or member 20 provides a breathing mask that is soft against the face of the wearer, yet able to retain its shape for long periods, even when it carries cartridges and is pulled, either directly from its perimeter or indirectly by a yoke mounted around the outer shell member 21 of the mask, against the face of the wearer for extended periods use.

Figure 7:
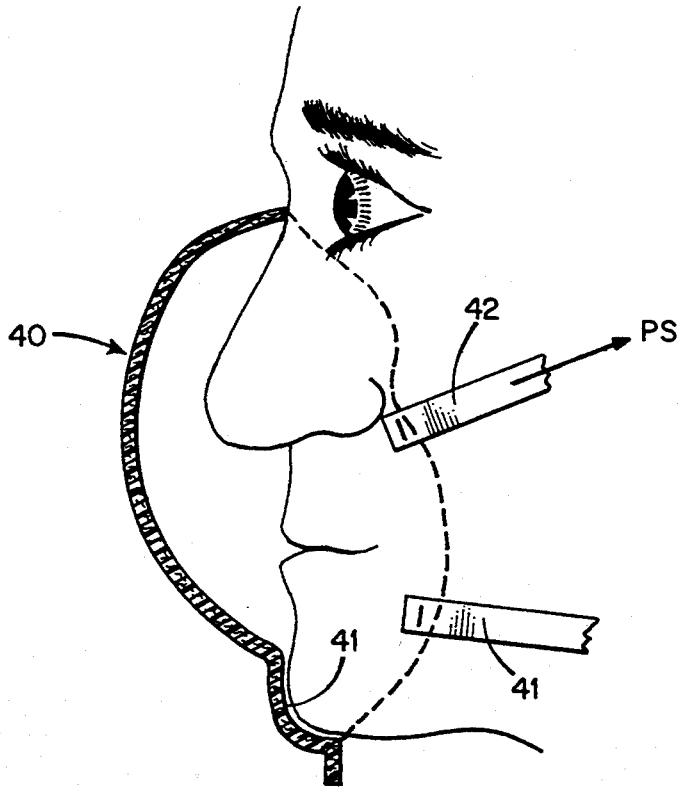
FIG. 7 is a side cut away view of a thermoformed fibrous shell mask embodiment of the present invention showing a chin cup in accordance with the teaching of the present invention.

FIG. 7 shows a side cut away view of a thermoformed fibrous she11 mask 40 featuring the chin cup 41 described in accordance with the teaching of the present invention. The chin cup 41 eliminates the problems of slippage referred to above in certain masks of the prior art (e.g. as shown in FIG. 1). Further, due to the earlier mentioned pivoting around the chin, the force P5 to required to be applied by band 42 for sealing the face of the wearer to the mask periphery is thus much smaller than as required in the prior art. This results in a greater level of comfort of the wearer.

While what has been described hereinabove is the preferred and one alternative embodiment of the invention, it will be obvious to those skilled in the art that numerous changes may be made without departing from the spirit and scope of the invention.

What is claimed is:

1. A breathing mask for filtering breathed air, the mask having an inner surface toward the face of a wearer of the mask and an outer surface away from the face of a wearer, said mask comprising:

an outer shell member formed of an air permeable, fibrous material to filter breathed air that passes therethrough, said outer shell member being formed of a first material, and said outer shell member having a periphery;

a face contacting member fabricated from a flexible, air imperious second material, said face contacting member being attached to the periphery of said outer shell member such that said outer shell member substantially completely covers said face contacting member said face contacting member having an inner edge that extends into the interior of said mask, said face contacting member being conformed to and touching the face of a wearer to form an air tight seal between the mask and the face of a wearer when the mask is worn, and said face contacting member forming a chin receiving cup cup, said cup retains its shape when said mask is worn and said cup forming a pivot point that prevents the mask from slipping under the chin of a wearer; and at least one strap having ends that are each attached to said mask, said strap being used to provide a force that pivots said mask about said pivot point and pulls said mask against the face of a wearer with minimal force to create an air tight seal between the face of a wearer and the face contacting member of said mask while preventing the inner surface of said outer shell member from touching the mouth and the tip of the nose of a wearer and preventing said mask from sliding under the chin of a wearer.

2. The breathing mask in accordance with claim 1 wherein said attachment of said outer shell member to said face contacting member creates a lip around the periphery of said mask which securely retains the lower edge of eye glasses or protective eyewear worn by a mask wearer between the mask lip and the face of a mask wearer.

3. A breathing mask for filtering breathed air the mask having an inner surface toward the face of a wearer of the mask and an exterior surface away from the face of a wearer, said mask comprising:

an outer shell member that comprises the exterior surface of said mask, said outer shell member being formed of an air impervious first material and having at least one hole through it, and said outer shell member having a periphery;

a face contacting member fabricated from a flexible, air impervious second material, said face contacting member being attached to the periphery of said outer shell member, said face contacting member having an inner edge that extends into the interior of said mask, said face contacting member being conformed to and touching the face of a wearer to form an air tight seal between the mask and the face of a wearer when the mask is worn, and said face contacting member forming a chin receiving cup, said cup retains its shape when said mask is worn and said cup forming a pivot point that prevents the mask from slipping under the chin of a wearer;

a filter which is attached to said outer shell member to filter breathed air passing through said at least one hole;

at least one strap having ends that are each attached to said mask, said strap being used to provide a force that pivots said mask about said pivot point and pulls said mask against the face of a wearer with minimal force to create an air tight seal between the face of a wearer and the face contacting member of said mask while preventing the inner surface of said outer shell member from touching the mouth and the tip of the nose of a wearer and preventing said mask from sliding under the chin of a wearer; and wherein said outer shell member joins said face contacting member and creates a lip around the periphery of said mask which securely retains the lower edge of eye glasses or protective eyewear worn by a mask wearer between the mask lip and the face of a mask wearer.

* * * * *